United States Patent [19]

Hill

[11] Patent Number: 4,535,716

[45] Date of Patent: Aug. 20, 1985

[54] MINESWEEPING

[75] Inventor: John W. Hill, Church Point, Australia

[73] Assignee: The Commonwealth of Australia, Canberra, Australia

[21] Appl. No.: 451,907

[22] Filed: Dec. 21, 1982

[30] Foreign Application Priority Data

Dec. 24, 1981 [AU] Australia ..... PF2077

[51] Int. Cl.[3] ..... B63G 9/00

[52] U.S. Cl. ..... 114/221 R; 114/244; 102/402

[58] Field of Search ..... 114/221 A, 221 R, 242, 114/244, 253; 89/1 A, 1 M; 102/402, 417

[56] References Cited

U.S. PATENT DOCUMENTS

| | | | |
|---|---|---|---|
| 2,371,404 | 3/1945 | Mumford | 114/244 |
| 3,375,324 | 3/1968 | Miller | 114/244 |
| 3,826,215 | 7/1974 | Dyjak | 114/221 R |
| 4,220,108 | 9/1980 | Burt | 114/244 |

FOREIGN PATENT DOCUMENTS

| | | | |
|---|---|---|---|
| 296666 | 8/1963 | Netherlands | 114/244 |

OTHER PUBLICATIONS

Hill, (IEEE), Sep. 1978, Composite Ferrite/Steel Bar Magnets.

Hill, (J. Phys.), vol. 11, 1978, Two-Domain Analysis.

*Primary Examiner*—Trygve M. Blix

*Assistant Examiner*—Stephen P. Avila

*Attorney, Agent, or Firm*—Townsend and Townsend

[57] ABSTRACT

A magnetic mine sweep has at least one block of permanent magnet material connected on each side in flux conducting relationship to respective distributor elements, typically of mild steel, which are secured to respective steel pipes which are closed to form cavities for providing buoyancy and for distributing the flux for mine sweeping purposes. Rigid plastic foam can be provided in the cavities for reserve buoyancy and stiffening purposes. A non-magnetic shroud extends around the block of permanent magnet material.

19 Claims, 8 Drawing Figures

MINESWEEPING

FIELD OF THE INVENTION

The present invention relates to mine sweeping and more particularly is concerned with the actuation of magnetic mines.

BACKGROUND TO THE INVENTION

Magnetic mine sweeping may be effected by towing a magnetised structure behind a non-magnetic ship; the magnetic field of the structure is such that any magnetic mine in the area being swept will be triggered. Early attempts at magnetic mine sweeping comprised towing an elongated homogeneous block of metal which was magnetised before use, usually the block of metal being in the form of a very long thin bar. Another proposal used by the United States Navy is that known as the Magnetic Orange Pipe which is a length of steel pipe, of the order of 10 inches diameter, magnetised before use and then towed behind a vessel.

These prior proposals, however, have the disadvantage that demagnetisation of the metal occurs in use and daily remagnetisation is usually required. Thus, a simple structure such as a magnetised steel pipe or rod is of limited value in view of the limited magnetic moment to mass ratio (M.M.R.) and the relative lack of permanence in the magnet.

Another known technique for magnetic mine sweeping comprises the use of minesweepers towing cables and/or electrodes and applying current whereby a magnetic field is established in water. However such a technique is not practical in very shallow water due to the risk of damage to the sweep gear.

Basic requirements for magnetic mine sweeping comprise the provision of a structure which is durable and inexpensive but nevertheless effective in providing a good magnetic field for activating mines while still being capable of being moved, shipped and handled in mine sweeping operations.

It is also well known that permanent magnets can be built from ferrites and at greater expense from Alnico. Although Alnico can provide very superior M.M.R. values, the cost of this material is high and is therefore not attractive when considering mine sweeping operations since there is a very real danger of the sweep being damaged beyond further use if a mine is exploded. It is desirable that the sweep be resistant to damage as well as being in a form which facilitates its handling in a small mine sweeping support vessel.

Prior techniques such as the Magnetic Orange Pipe arrangement relied on very long slender structures for the sweep, this being necessary in order to provide a reasonable degree of magnetism. However this form of structure offers practical disadvantages in terms of handling, shipment and storage. The present invention is concerned with new and useful alternatives to prior proposals.

SUMMARY OF THE INVENTION

According to the present invention, there is provided a sweep for use in magnetic mine sweeping, the sweep comprising a body which will float when in use in water, the body including at least one sealed cavity containing a block of permanent magnet material, distributor elements of high magnetic permeability and saturation level (such as mild steel) being provided in flux conducting relationship with the opposite poles of the or each said block of permanent magnet material, and the sweep being dimensioned and constructed such that the sweep will float and provide a magnetic field effective for magnetic mine sweeping purposes and will be resistant to the explosive forces released by a magnetic mine when activated by the sweep. In this specification, a mine sweep is considered "resistant" to damage upon mine detonation even though it may be damaged beyond repair if a mine is detonated sufficiently close to it and the mine has sufficient power.

Ferrite material may be used with advantage for the or each permanent magnet. When two or more such blocks are used, they should be spaced along the body which preferably is of generally cylindrical shape with an intermediate section disposed between each pair of adjacent ends of the blocks, and end sections being disposed outside the remote ends of said blocks of ferrite material, the intermediate and end sections being arranged to provide the distributor elements for said blocks.

Most preferably, buoyancy for the sweep as well as structural strength can be provided in a simple and effective manner by suitable design of said distributor elements, each of which can be hollow and sealed. In a preferred and important embodiment of the invention, a rigid plastic foam is provided within each of the distributor elements whereby enhanced resistance to explosive forces from a detonated mine is provided.

Advantageously for mine sweeping purposes, the sweep can be cylindrical with a diameter of the order of 500 mm. and a length of the order of 6 m. the structure can readily be designed so as to be rigid and durable with suitable fittings welded to the outside of the sweep to permit handling and towing. Furthermore, a highly advantageous magnetic field can be provided for the purpose of mine sweeping in a cost effective manner.

Most preferably, the or each block of permanent magnet material is of disc-like form and is held in position by a suitable non-magnetic structure. For economic manufacture each block can be of polygonal shape.

One form of fabrication comprises mounting the or each permanent magnet block by a non-magnetic band to a projecting, reduced diameter end portion of a pipe which forms part of the body and forms one of the distributor elements. A portion of the pipe adjacent its point of reduction in diameter is screw threaded for receipt of a non-magnetic sealing sleeve, the exterior diameter of which conforms with the exterior diameter of said pipe. To ensure sealing, an O-ring seal is provided adjacent to the joint. All of the said pipes have end faces formed so as to be pressed into intimate contact with the permanent magnet assembly with minimal air gap for flux transfer and distribution purposes.

It may be said that the present invention, broadly speaking, can be considered to be based on the concept of realising that an effective solution for mine sweeping is available with a suitably scaled and dimensioned structure including at least one block of permanent magnet material in combination with suitable flux distributor elements whereby a conveniently handled robust, floating body providing an effective magnetic field for mine sweeping purposes can be economically constructed.

In designing a particular embodiment of sweep, it is considered that use may be made of work published by the present inventor of a laboratory scale magnet of composite structure but hitherto not previously recognised or proposed for practical scale operations or for mine sweeping purposes.

For an understanding of the theoretical principles which may be applied to the present invention, reference may be made to the article "Composite Ferrite/-Steel Bar Magnet" by J. Warren Hill, published in I.E-.E.E. Transactions on Magnetics, Volume Mag-14, No. 5, Sep. 1978, pages 1054–1058, and the article "Two-Domain Analysis of Field-Producing Bodies, Using Fictitious Poles" by J. Warren Hill, published in J. Phys. D:Appl. Phys, Volume 11, 1978, pages 509–530.

At least in preferred embodiments of the invention, advantage can be taken of a mine sweeping device having high magnetic stability, good M.M.R. value and suitable for volume production in a convenient and effective way at low cost. It is considered that such a mine sweep can be greatly superior to previous proposals and in particular greatly superior to the Magnetic Orange Pipe proposal referred to above. Embodiments of the present invention can maintain, possibly indefinitely, the magnetic qualities initially provided and thus reliable mine sweeping can occur. The ability to construct a mine sweep so that it will be durable even under harsh service conditions, but nevertheless reliable and also inexpensive initially, are very important factors. It will be appreciated that it is desirable to provide the maximum magnetic moment possible in a magnetic mine sweep.

According to another inventive aspect, there is provided a method of storing and shipping sweeps for use in magnetic mine sweeping operations and there is also provided a configuration of such sweeps suitable for storage or shipping and characterised by a low resultant external magnetic field whereby interference for example with the magnetic compasses of ships and aircraft is substantially prevented. In this aspect such a package suitable for shipment comprises a multiplicity of elongated sweeps disposed generally parallel to one another in an array with the poles of adjacent sweeps being of opposite sign.

A most highly beneficial and preferred embodiment of this inventive aspect comprises a configuration of sweeps in which four sweeps are arranged in a square array with their longitudinal axes substantially parallel.

BRIEF DESCRIPTION OF THE DRAWINGS

For illustrative purposes only, embodiments of the invention will now be described with reference to the accompanying drawings of which.

DETAILED DESCRIPTION OF THE DRAWINGS

The embodiments described below with reference to the drawings have been found to provide a very high magnetic moment to mass ratio (M.M.R.) which compares very favourably with expensive conventional Alnico magnets when account is taken of the vehicle (e.g. small boat, barge, or raft) necessary to carry such magnets. The illustrated embodiments each provide essentially a hollow mild steel float including a permanent magnetic assembly.

Figure 1:
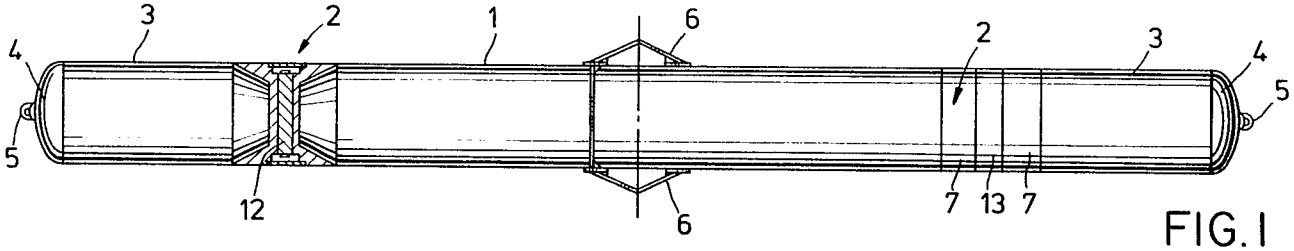
FIG. 1 is a schematic axial cross-sectional view through a first embodiment of magnetic mine sweep.
Figure 2:
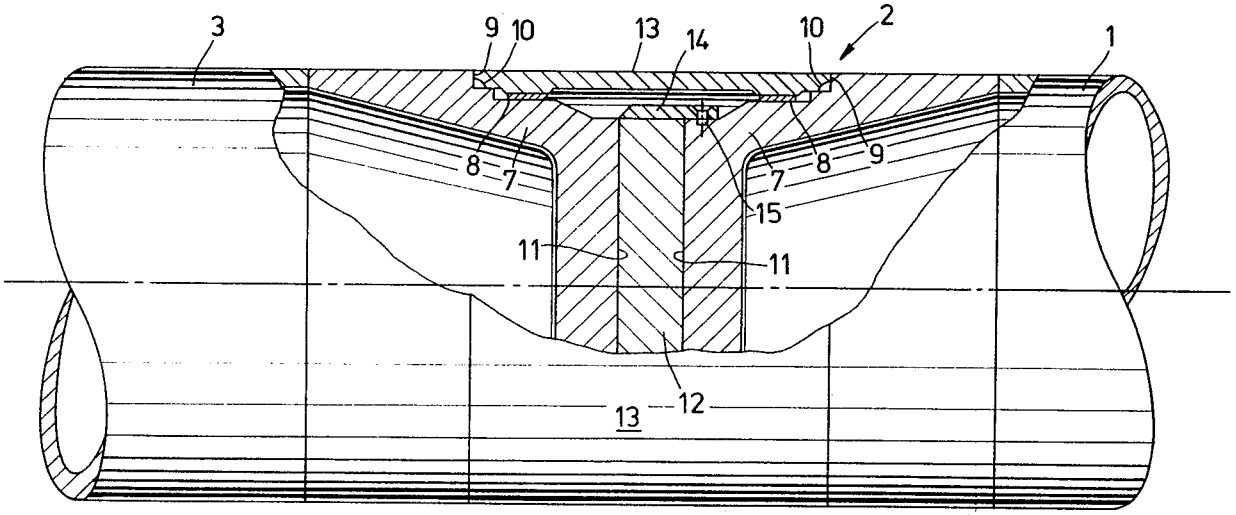
FIG. 2 is a partial axial cross-sectional view on an enlarged scale illustrating the construction at the region of a ferrite permanent magnet disc in the mine sweep of FIG. 1.

Referring first to FIGS. 1 and 2, the magnetic mine sweep is of cylindrical form and comprises a central steel body 1, permanent magnet ferrite disc structures 2 and end steel pipe units 3 having curved end caps 4 fitted with towing eyes 5.

The central steel body 1 and the end steel pipes 3 are of mild steel of low carbon content, e.g. less than 0.25%. To provide resistance to damage under explosive force from a detonated mine and to provide reserve buoyancy in the event of leakage, the steel bodies are all injected with rigid polyurethane foam (omitted from the drawing for the purposes of clarity) formed in situ and at high density, e.g. 65 kg. per cubic meter. This has been found to have a very low water absorption potential and to provide substantial stiffening of the structure thereby resisting buckling of the structure under explosive forces.

At the centre of the central steel body 1, lifting lugs 6 are welded to each side of the body, and appropriate internal stiffening also is provided.

Reference to FIG. 2 shows the detail of each junction of a ferrite disc structure 2 with pipe elements 1 and 3. The ends of the central steel body 1 and steel pipe unit 3 are similar and each comprises a reduced diameter end portion 7 externally screw threaded at 8 and providing a shoulder 9 against which a rubber O-ring 10 can abut in sealing relationship. A flat end face 11 is provided on each of the end portions 7 for placement in intimate contact with the ends of a ferrite disc element 12.

A non-magnetic connection between the steel cylindrical portions is provided by virtue of an external aluminium alloy connecting ring 13 which is internally screw threaded at locations set back from the ends, a recess being provided internally for accommodating each O-ring seal 10. An aluminium alloy collar 14 is provided for retaining the ferrite disc element 12, the collar being secured to an annular shoulder provided at the end of the central steel pipe 1 by means of stainless steel screws 15.

Suitable precautions are taken to ensure that intimate solid contact is established between the flat end faces of the steel pipe sections and ferrite disc element 12 for maximum flux transfer. The flat ends of the end portion 7 must be thick enough to collect magnetic flux and direct it to the body walls which also must be thick enough to avoid loss of magneto-motive force.

Figure 3:
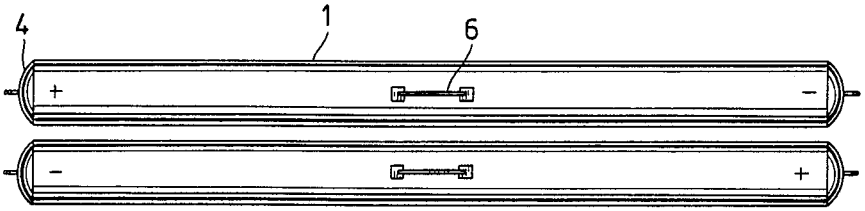
FIG. 3 illustrates a configuration of four mine sweeps in square array configured to minimise the external magnetic field so as to avoid interference with ship's compasses and the like, FIG. 3 being a plan view of the configuration.
Figure 4:
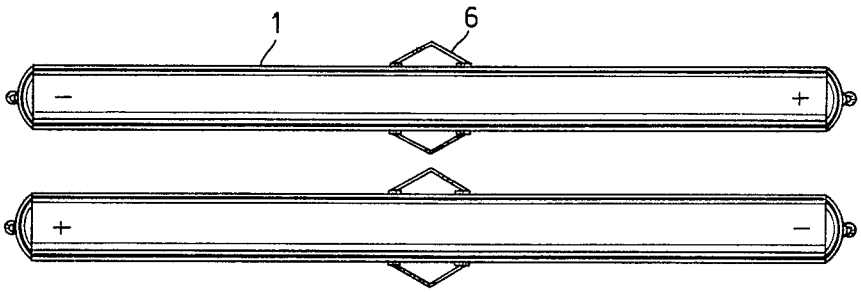
FIG. 4 is a front elevation of the configuration of FIG. 3.
Figure 5:
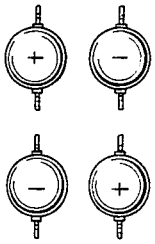
FIG. 5 is an end view of the configuration.

Referring now to FIGS. 3 and 5 an array of four mine sweeps is shown. It will be noted that north and south poles alternate and it has been determined that this configuration surprisingly results in a very low external magnetic field whereby interference with magnetic compasses in aircraft and the like is avoided.

Figure 8:
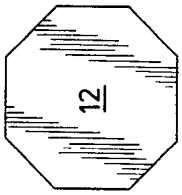
FIG. 8 is an end view of the ferrite disc element of the ferrite disc structure of FIGS. 6 and 7.
Figure 7:
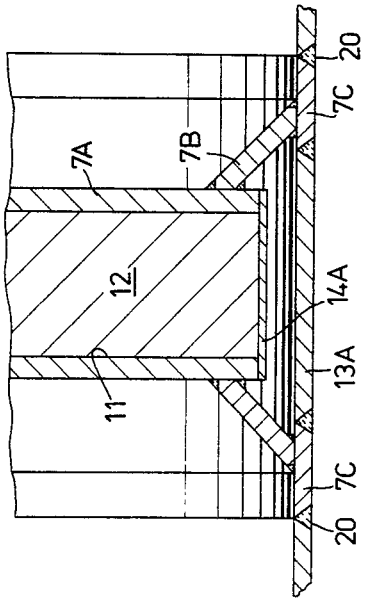
FIG. 7 is an enlarged view in axial cross-section showing the mounting of a permanent magnet ferrite disc structure of the embodiment of FIG. 6.
Figure 6:
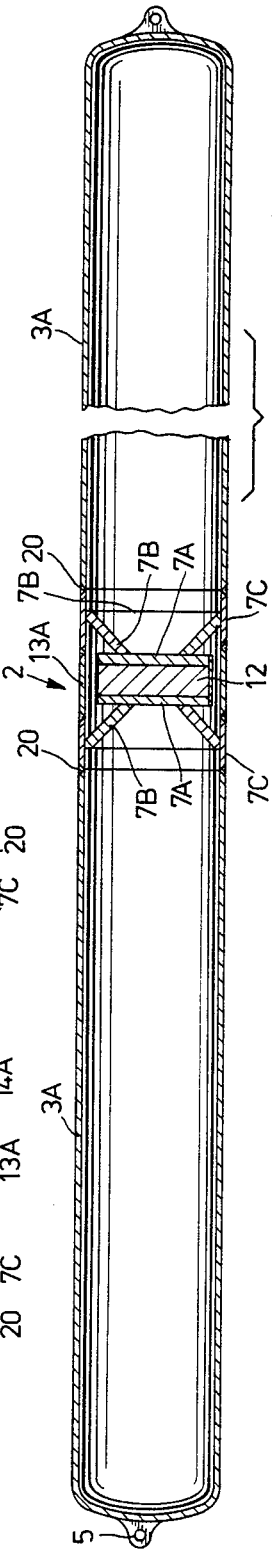
FIG. 6 is an axial cross-sectional view through a second embodiment of mine sweep.

In the embodiment of FIGS. 6 to 8 like reference numerals have been used for like parts and only the differences in construction will now be highlighted.

The embodiment of FIGS. 6 to 8 is designed with economy in mind with relatively simple construction formed by welding together components from material of uniform thickness, thereby obviating expensive casting and machining operations whilst nevertheless preserving an adequate performance in terms of distribution of magnetic flux for mine sweeping purposes. Bearing in mind that a mine sweep has a substantial risk of damage, it must be a potentially expendible item and therefore economy of manufacture may outweigh optimum performance factors providing an adequate level of performance can be achieved.

The embodiment of FIGS. 6 to 8 comprises an overall cylindrical shape with hollow tubular mild steel end sections 3A welded at annular welds 20 to a central ferrite disc structure 2.

The disc structure 2 comprises an octagonal central block of ferrite 12 having flat end faces 11 in intimate contact with mild steel end plates 7A of flux distributor elements welded at locations set in from their respective peripheries to mild steel conical elements 7B which in turn are welded around their peripheries to mild steel connecting collars 7C. The detail of the structure and the location of the welds is best shown in FIG. 7 wherein a non-magnetic ferrite retaining sleeve 14A is most clearly shown for retaining the ferrite block 12 in position.

Furthermore, a stainless steel (non-magnetic) shroud 13A forms part of the overall cylindrical body of the mine sweep and provides a central part of the disc structure 2. The shroud 13A is welded as shown in FIG. 7 to the respective ends of the collars 7C.

I claim:

1. A sweep comprising an elongated rigid buoyant body dimensioned and constructed for deployment in water as a magnetic mine sweep and being resistant to explosive forces released by a magnetic mine when activated by the sweep, the rigid body including:

at least one block of permanent magnet material having pole faces; and distributor elements of a material of high magnetic permeability and high saturation level, the distributor elements being mounted with faces thereof in intimate proximity to the pole faces for conducting the flux with little loss of magnetomotive force, the distributor elements associated with the or each said block extending away from the pole faces thereof in opposite directions and along the direction of elongation of said rigid body for distributing the magnetic flux so as to establish a magnetic field extending through the water for magnetic mine sweeping purposes and whereby the sweep has long service life between remagnetizations and a high ratio of magnetic moment to mass.

2. A sweep as claimed in claim 1 and wherein the distributor elements are of mild steel.

3. A sweep as claimed in claim 1, wherein each of said distributor elements is a sealed hollow structure providing buoyancy for the sweep and having a wall providing an elongated casing extending away from the associated block of magnet material.

4. A sweep as claimed in claim 1, and wherein said body has one sealed cavity is filled with rigid plastic foam for providing stiffening and reserve buoyancy.

5. A sweep as claimed claim 1, and wherein the or each block of permanent magnet material is of disc-like form and held in position by a non-magnetic structure.

6. A sweep as claimed in claim 1, and wherein the or each block of permanent magnet material is of polygonal cross-section shape when viewed transverse to its polar axis.

7. A sweep as claimed in claim 1 wherein a non-magnetic shroud is provided around the or each block of permanent magnet material and forms an exterior wall of the body and is connected to the distributor elements on each side of the block of permanent magnet material.

8. A sweep as claimed in claim 1, and wherein each distributor element comprises a flat steel plate in magnetic flux conducting relationship with the corresponding pole of the associated block of permanent magnet material and a steel connecting wall welded to and extending at an angle to the axis of the body from said flat plate to a welded connection with a steel casing for the body.

9. A sweep as claimed in claim 8, wherein the connecting wall is substantially of conical shape extending from a portion of the flat plate located radially inwardly from the periphery of the flat plate.

10. A sweep as claimed in claim 1 and including at least two blocks of permanent magnet material spaced along the sweep and having respective distributor elements associated therewith, the body including hollow steel cylindrical intermediate and end sections forming part of the distributor elements and forming sealed cavities.

11. A sweep as claimed in claim 1 wherein the body has an overall cylindrical shape of the order of 500 mm. diameter and 6 m length.

12. A package of mine sweeps, each of which is as claimed in claim 1 and comprising an arrangement of sweeps in side by side relationship with adjacent poles of opposite sign.

13. A sweep as set forth in claim 1, wherein the distributor elements are tapered.

14. A mine sweep comprising a buoyant elongated body adapted to be towed through water, a block of permanent magnet material mounted within the body, and distributor elements of high magnetic permeability and low coercivity steel each providing a sealed, rigid, hollow casing for the body and for providing buoyancy for the body, and the distributor elements having respective flat distributor surfaces in intimate flux conducting contact with and extending away from respective pole faces of said block of permanent magnet material.

15. A mine sweep as claimed in claim 14, wherein each of said casings is filled with rigid foam plastics material.

16. A mine sweep as claimed in claim 14 or claim 15, wherein a non-magnetic rigid shroud surrounds said block of permanent magnet material, and is in sealed connection with said casings to provide a streamlined exterior for said body.

17. A sweep for use in magnetic mine sweeping, the sweep comprising a buoyant body which includes:

at least one sealed cavity containing a block of permanent magnet material;

distributor elements of high magnetic permeability and saturation level, each distributor element comprising a flat steel plate in magnetic flux conducting relationship with a corresponding face of the block of permanent magnet material, the flat steel plates distributing the magnetic flux, when the sweep is in use, to establish an extended magnetic field for magnetic mine sweeping purposes, and a steel connecting wall welded to and extending at an angle to the axis of the body from each flat steel plate to a welded connection with a steel casing for the body; and the body being resistant to explosive forces released by a magnetic mine when activated by the sweep.

18. A sweep as claimed in claim 17, wherein the connecting wall is substantially of conical shape extending from a portion of the flat plate located radially inwardly from the periphery of the flate plate.

19. A sweep as set forth in claim 18, wherein the distributor elements comprise four steel plates configured to form a generally truncated pyramid structure.

* * * * *